United States Patent [19]

Resnick et al.

[11] 4,016,674

[45] Apr. 12, 1977

[54] MINIATURE TOY VEHICLE LAUNCHER FOR LAUNCHING A TOY VEHICLE UNDER THE INFLUENCE OF GRAVITY

[75] Inventors: Charles Resnick, Great Neck, N.Y.; Fred Zant, Boonton, N.J.

[73] Assignee: Lesney Products Corporation, Moonachie, N.J.

[22] Filed: Mar. 18, 1976

[21] Appl. No.: 668,038

[52] U.S. Cl. ..... 46/202; 46/1 C; 46/206

[51] Int. Cl.[2] ..... A63H 18/16

[58] Field of Search ..... 46/1 C, 201, 202, 206; 273/86 C

[56] References Cited

UNITED STATES PATENTS

| | | | |
|---|---|---|---|
| 3,160,984 | 12/1964 | Ryan | 46/232 |
| 3,658,333 | 4/1972 | Carcel | 273/86 C |

*Primary Examiner*—Louis G. Mancene
*Assistant Examiner*—Robert F. Cutting
*Attorney, Agent, or Firm*—James E. Ryder

[57] ABSTRACT

A miniature toy vehicle launcher having an inclined platform adapted to support a toy vehicle in a launching position. A stop is provided which is movable from a hold position to hold the toy vehicle on the platform against movement and to a release position for release thereof. A finger is movably coupled with the stop to move it to the hold position, and the stop is spring biased by means of a first spring towards the release position to move the stop to the release position. A locking element retains the stop in the first position against the tension of the first spring, and a slide is spring biased by means of a second spring for movement to disable the locking element to cause the stop to move to its release position. The launcher includes a sound apparatus to simulate a vehicle launching sound, and a handle is provided both to activate the sound apparatus and to cam the slide at a point in the path of movement of the handle, to overcome the bias of the second spring to move the stop to its release position by means of the spring action of the first spring.

18 Claims, 9 Drawing Figures

MINIATURE TOY VEHICLE LAUNCHER FOR LAUNCHING A TOY VEHICLE UNDER THE INFLUENCE OF GRAVITY

BACKGROUND OF THE INVENTION

1. Field of the Invention

This invention relates to amusement devices, and more particularly, to a miniature launching device for a toy vehicle adapted for movement on a ground level or a guided track.

2. Description of the Prior Art

Launching devices for toy vehicles which are adapted to be propelled and then to travel in a controlled pathway are known. In particular, U.S. Pat. No. 3,665,636 discloses means to hold a toy vehicle and to start it along a guided trackway. This is a large and cumbersome unit. U.S. Pat. No. 3,674,269 also discloses a large sophisticated device for starting a number of toy vehicles. In addition, starting mechanisms such as the type disclosed in U.S. Pat. No. 3,717,346 are available to start self-propelled toy vehicles onto a trackway. Launchers of the type disclosed in U.S. Pat. No. 3,777,391 which are provided with propelling means are also known.

OBJECTS AND SUMMARY OF THE INVENTION

It is an object of this invention to provide for a miniature toy vehicle launcher which is adapted to hold a toy vehicle against launching and to permit it to be launched into a free pathway or guided trackway under the influence of gravity.

Another object of the invention is the provision of miniature toy vehicle launcher which may be attached to a fixed object and includes means to simulate the noise of an actual vehicle "revving-up" prior to launch and to activate the mechanism to permit the toy vehicle to be launched into a free pathway under the influence of gravity.

The present invention provides for a miniature toy launcher which is adapted to be supported by a clamping device or on the ground in conjunction with a trackway and includes a housing having an inclined platform forming the top thereof for the support of a toy vehicle. The operating mechanisms are contained within the housing with the control elements being accessible outside of the housing. For this purpose, a stop is provided which is movable from a first or release position in which it does not interfere with the path of travel of the toy vehicle into a second or hold position and projects into the path of the toy vehicle to prevent it from moving. A spring is provided to urge the stop towards its release position from the hold position, and a retaining means is provided to retain the stop in its hold position, and a disabling means is provided to disable the retaining means.

A sound apparatus is provided for simulating the sound of a launched vehicle, and an actuating lever is provided which is movable to operate the sound apparatus and to operate the disabling means at a preselected point in the movement of the lever to permit launching of the vehicle while the sound making apparatus produces the sound.

The sound is contained within the housing and is adapted to simulate the noise of a vehicle starting-up or "warming-up" or "revving-up". The sound apparatus includes a noise mechanism which is adapted to engage a knocker plate on the inside of the top of the housing to provide for the simulated noise quality. Gearing is provided intercoupling the handle with the noise mechanism so that for certain movements of the handle the noise mechanism is rendered operative and for another movement of the same handle the stop is moved from its hold to its release positions to permit the toy vehicle to be launched solely under the influence of gravity and to travel in a free path or a guided trackway.

Other objects, advantages and the nature of the invention will be more fully understood from the following description of the preferred embodiment of the invention, shown, by way of example, in the accompanying drawings:

DESCRIPTION OF THE PREFERRED EMBODIMENT

Figure 2:
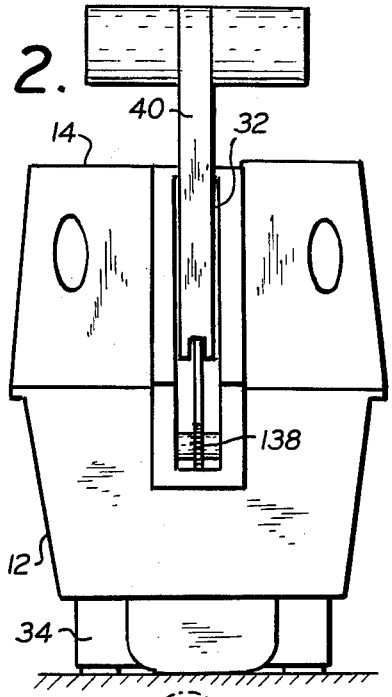
FIG. 2 is a rear view of the launcher of FIG. 1.
Figure 3:
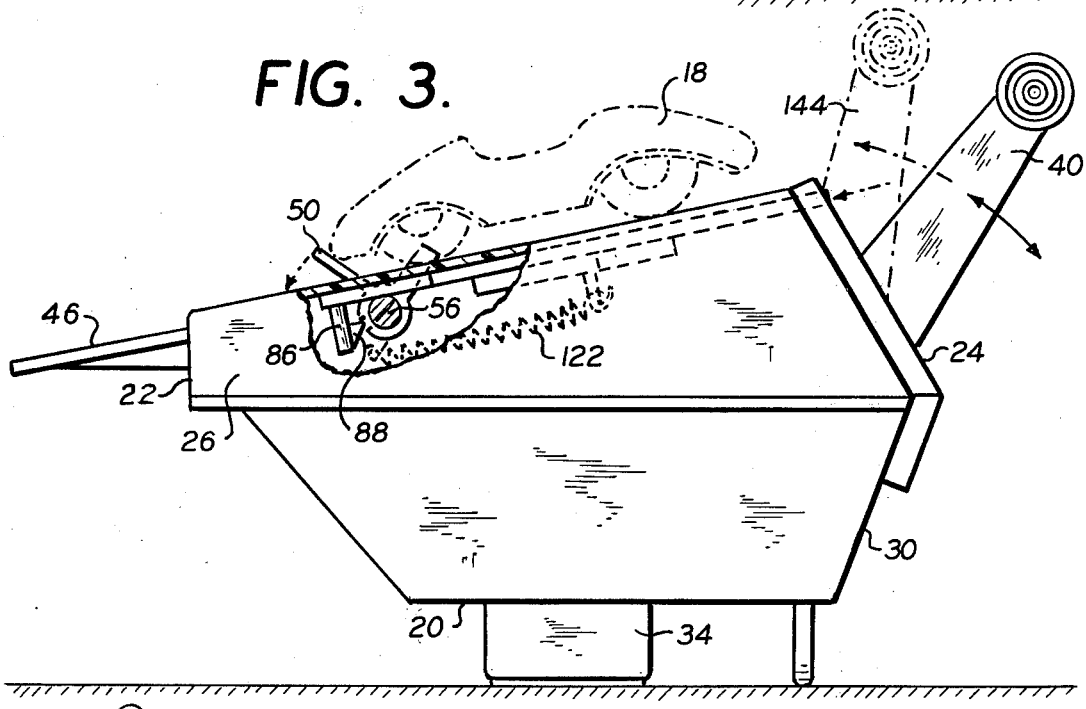
FIG. 3 is a side view of the launcher of FIG. 1 with a toy vehicle thereon shown in phantom.

Referring now more particularly to the drawings in which a preferred embodiment of the invention is disclosed, the toy vehicle launcher housing 10 comprising a base portion 12 and platform portion 14 having a trackway 16 adapted to hold a toy vehicle 18 shown in phantom in FIG. 3. The base portion 12 includes a base 20 and four upstanding generally vertical walls forming a generally rectangular member which mate with four walls 22, 24, 26, 28 depending from the platform 14. It should be noted that walls 26 and 28 are longer than walls 22 and 24 and have a general trapezoidal shape so as to provide for the appropriate incline. Walls 22 and 24 are smaller, and it will be noted that wall 24 mates with a small wall 30 of the base portion 12, and both walls 24 and 26 have a transverse opening 32 (see FIG. 2) which extends substantially the entire length of wall 24 and partially to the base of wall 30. The base portion 20 is suitably supported by legs 34 for placement onto a ground level. The launcher may be hand held or operated on ground level by a user. The platform 14 and base portion 12 are held together by suitable connection means such as screws 36. Contained within the housing 10 formed by base portion 12 and the platform means 14 is a sound apparatus 38, the operation of which will be explained hereinafter. A handle 40 is connected with the sound apparatus 38 and extends from the inside of the housing 38 outside of the housing through the transverse opening 32.

Figure 1:
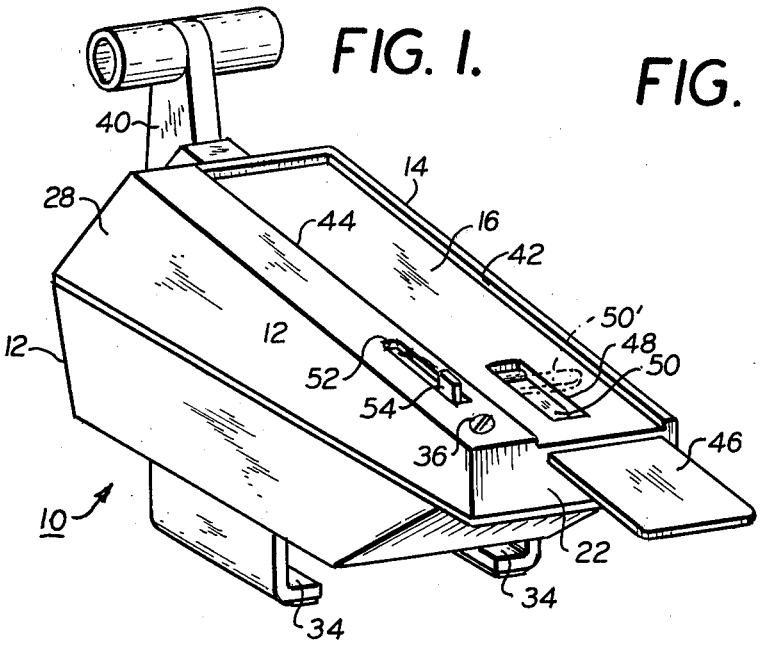
FIG. 1 is a perspective view of the miniature toy launcher in accordance with the invention.

The platform portion 14 contains the operating mechanism for holding a toy vehicle onto the platform as well as the operating mechanisms to release the toy vehicle, and it cooperates with the base portion 12 which contains and supports the operating mechanisms to provide the sounds simulating the "revving-up" of a motor vehicle as well as the handle 40 to commence the movement of the toy vehicle held onto the platform 14. It will be obvious that different sounds may be simulated merely by substituting different sound mechanisms. The platform 14 includes a sideway 42 connected by a vertical portion 44. Extending from the trackway 16 is an extension portion 46 extending generally in a parallel direction with the trackway 15 and having substantially the same inclination so as to effectively increase the length of the trackway and to provide for further impetus to the launching of the toy vehicle. The extension portion 46 is shown parallel with the trackway 16, but slightly lowered therefrom, and it should be noted that it is within the scope of this invention to make extension 46 continuous with trackway 16. The trackway 16 includes a transverse opening 48 therethrough communicating with the interior of the toy vehicle launcher housing 10 and includes a stop or stop finger 50 projecting therethrough which is movable from its release position parallel with the trackway 16 as shown in full outline in FIG. 1 to its hold position shown in dotted outline transverse to said trackway. The stop 50 is shown extending out of the transverse opening 48 in full outline in FIG. 3 in the hold position with the toy vehicle 18 being held by the stop. Sideway 22 is also provided with a transverse opening 50 which communicates with the interior of the housing 10. A setting finger 54 is movable within the transverse opening 52 to move the stop 50 from its release position shown in full outline in FIG. 1 to its hold position shown in phantom or dotted outline.

The setting finger 54 is connected with the stop 50 for movement therewith by means of a shaft 56 and this forms part of a mechanism for locking the stop 50 in its hold position as well as to release the stop and to enable it to move towards its release position. For this purpose, the underside of the platform 14 is provided with a guide means which includes a first guideway or portion 58 connected with a second guideway or portion 60 by means of vertical guiderail or guide edge trackway 62 connecting the first and second guideways together. The first guideway 58 is higher than the second guideway 60 in the operating position of the toy vehicle launcher housing 10, and the first guideway 58 is positioned underneath the sideway 42 and the second guideway 60 is positioned underneath the trackway 16. The first guideway 58 is provided with a pair of rails or a U-shaped track member formed of upstanding member 66 extending vertically from the guide edge trackway 62 and a pair of guide members or vertical projections 68 forming the other part of the U-shaped trackway.

Figure 8:
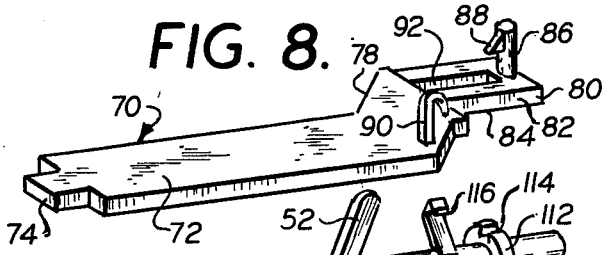
Figure 5:
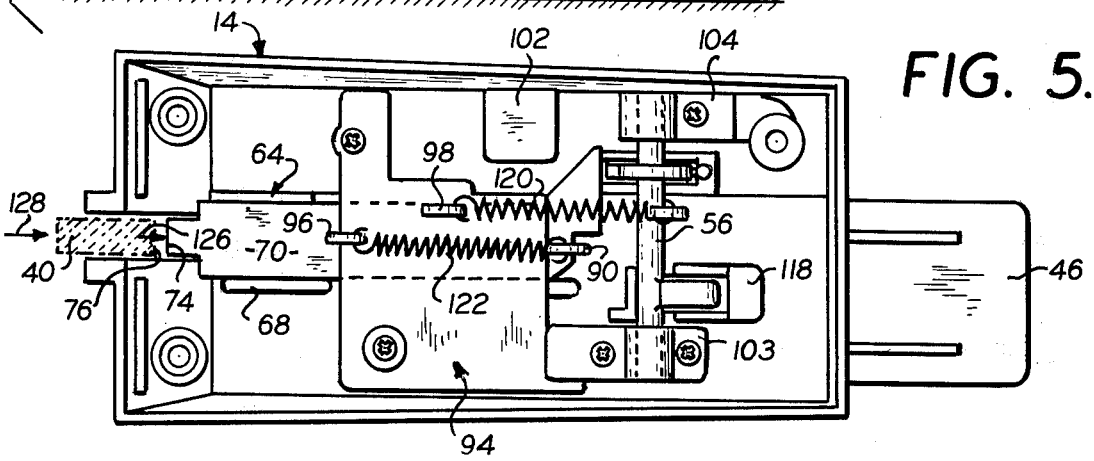
FIG. 5 is a sectional view taken along line 5—5.
Figure 6:
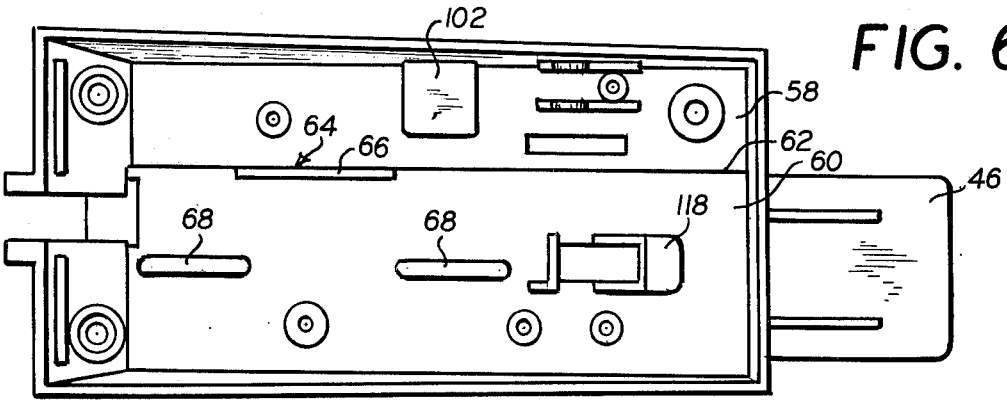
FIG. 6 is a view similar to FIG. 5, but with parts thereof removed to show the underparts more clearly.

A slide member 70 (see FIGS. 5 and 8) is provided having a first portion 72 and a second portion 80. The first portion 72 is provided with a camming edge 74 which is adapted to slide within the U-shaped rail 64 formed by the rails 66 and 68 so as to permit the camming edge 74 which is adapted to cooperate with a camming surface 76 provided on handle 40, to move in response to certain predetermined movements of handle 40. The first portion of slide 72 is provided at its other end with an offset portion 78 which carries and supports the second portion 80 of the slide. The second portion 80 is a depending member which depends from offset portion 78 and has an edge 82 which is guided for movement along the guide edge trackway 62 with the base portion 84 of member 82 riding along the first guideway 58.

The slide member 70 carries a locking element 86 on its second portion 80 projecting perpendicularly therefrom and includes a locking lug 88 projecting normally from the locking element 86 parallel to the base portion 84 for a purpose to be explained hereafter. The slide member 70 also carries on its first portion at the offset portion thereof a spring holding hook 90. The second portion or depending member 80 is provided with a longitudinal opening 92 which is generally coextensive with the transverse opening 50. The locking element 86 and lug 88 are positioned on one side of the longitudinal opening 92 remote from the offset portion 78 and in general alignment with the opening 92.

Figure 7:
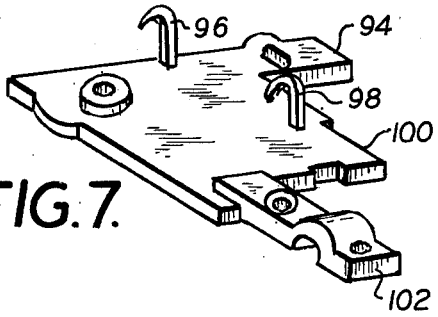
FIGS. 7, 8 and 9 illustrate in detail the parts removed from FIG. 6.

An inner housing plate 94 (see FIGS. 5 and 7) is provided to hold the slide member 70 within the U-shaped trackway 64 and includes a pair of spring holding hooks 96 and 98, an opening portion 100 to provide access to a knocker plate 102 carried underneath the first portion 58. Opening portion 100 is provided to provide access to the knocker plate for the appropriate part of the sound apparatus 38. The inner housing plate 94 is connected to the underside of the platform 14 by means of suitable connection means such as screws, and includes a first bushing 102 to hold and to journal the shaft 56 to the inside of the upper housing or the underside of platform 14. The inner housing plate 94 may include a second bushing 104 or this may be separated therefrom as shown. It is evident that it is within the purview of this disclosure to have bushings 102 and 104 connected as an integral unit with the inner housing plate or separately as shown.

Figure 9:
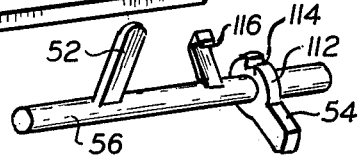

Shaft 56 (FIGS. 5 and 9) carries a collar 112 having a notched portion or detent 114, and connected with the collar 112 and extending therefrom is the setting finger 54. The setting finger 54 is adapted to rotate the shaft 56 so as to rotate the collar 112 to bring the notched portion or detent 114 into registry with the lug portion 88 on the locking element 86. Both the stop 50 and the setting finger 50 are connected with the shaft 56 and are angularly displaced from each other so that rotation of the setting finger will also rotate the stop 50. It is to be noted from FIG. 1 that the setting finger 54 is rotatable in the direction of the arrow so to move from one side of transverse opening 52 to the other to move the stop from its full outline to its dotted outline position projecting out of opening 48. Shaft 56 also carries a spring hook connection 116. The second guideway is provided with a stop limiting portion 118 to limit the movement of the stop 50 into the interior of the housing 10. A first opening 120 is provided and has one end connected to post 98 on the inner housing plate 94 and its other end connected to spring post or spring hook connection 116 on the shaft 56. The spring is so-tensioned to urge the shaft 56 to rotate in a direction to move the stop from its hold to its release position into a position parallel to the trackway 16. And, the stop limit 118 prevents the further the further rotation of the shaft 56 under the tension of the spring 120. The setting finger 54 is arranged to move the shaft 56 or to rotate the shaft in a direction opposite to the direction exerted by the tension action of spring 120 to move the stop into its holding position and to move the notch 114 into registry with the lug 88 so as to lock the collar 112 and shaft 56 with respect to the locking element 86 and to hold the stop 50 in its hold position. Collar 112 is rotatable within longitudinal opening 92, and the longitudinal opening 92 together with the collar 112 and the guide edge trackway 62 further assists to maintain the second portion of the slide 70 in its appropriate alignment position for sliding movement.

A second spring 122 also under tension is provided which is connected between spring post 96 on the inner housing plate 94 and the spring post 90 on the slide 70. Slide 70 is held in its normal position by spring 122 with the camming edge 74 within transverse opening 32 and projects further within the transverse opening 32 to the edge thereof for engagement with the camming surface 76 when the setting finger 54 is moved to move the stop 50 to its hold position. When the camming surface 76 is moved into engagement with the camming edge 74 by handle 40, such movement is effective to overcome the tension of spring 122 and to move the slide element 70 in a direction shown by the arrow 126. Arrow 128 shows the direction of movement of the handle 40 when it moves the slide in the direction of arrow 126, and this movement which overcomes the tension of the second spring 122 is effective to move lug 88 out of engagement with notch 114 so as to cause shaft 56 to rotate under the tension force of the first spring 120 to move the stop 50 into its release position substantially parallel with the trackway 16 and held against further movement by the stop limit 118.

Figure 4:
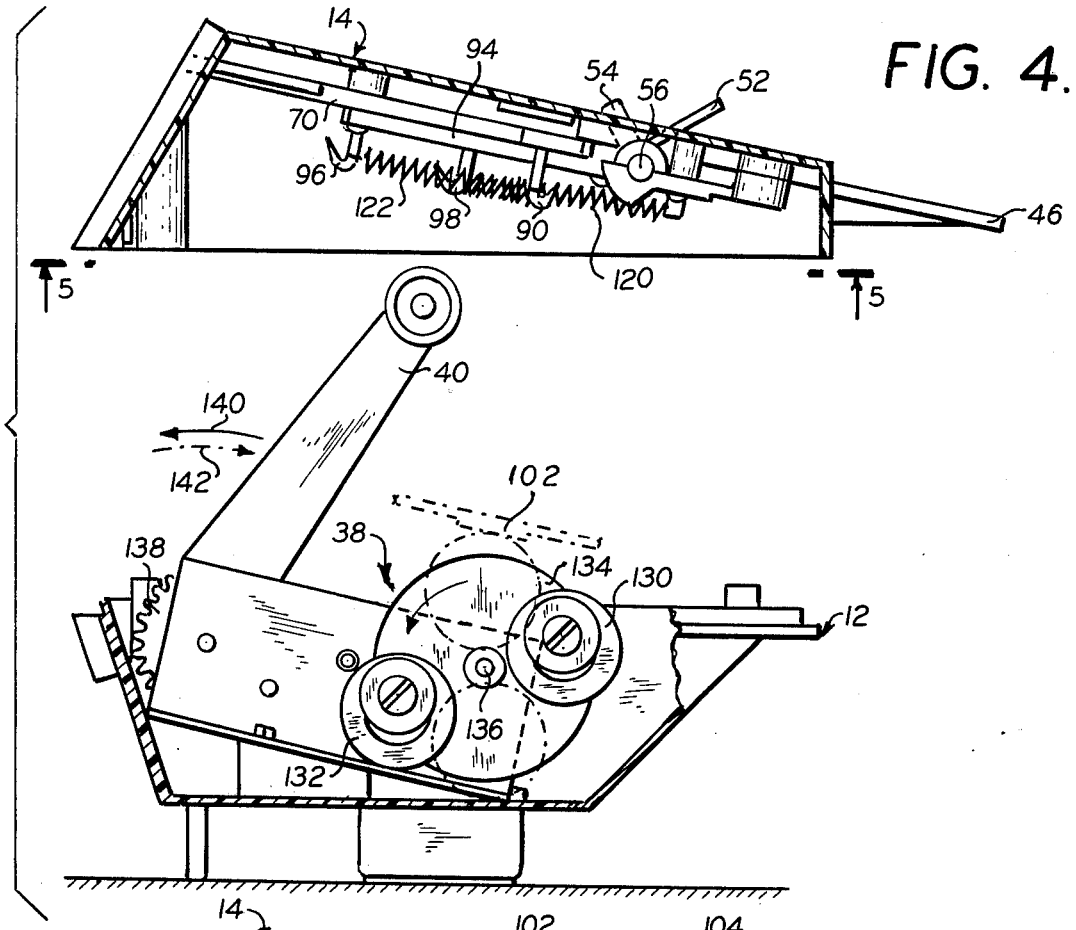
FIG. 4 is a vertical sectional view with the top and bottom portions separated, but bracketed to illustrate that both parts are normally joined together.

The sound apparatus 38, as best seen in FIG. 4, includes a pair of diammetrically opposed rollers 130 and 132 connected with a sun-member 134 rotates about its axis 136 and is connected through conventional gearing mechanism 138 to the handle 40. The sound apparatus 38 is generally conventional and the rollers 130 and 132, which are loosely positioned on the outer periphery of the sun member 134, rotate loosely about their own axis and rotate in response to the to-and-fro oscillation of handle 40 as shown by the direction of the arrows 140 and 142. Oscillation of the handle 40 is effective to rotate the member 134 and alternately to bring the rollers 130 and 132 into contact with the knocker plate 102 underneath the first guideway 58. The contact made by the roller elements 132 and 134 when contacting the knocker plate provides for the appropriate sound to simulate the sound of a motor car revving up. As noted heretofore, the opening 100 in the inner housing plate 94 permits the roller elements 132 and 134 to make the contact with the knocker plate 102. The gearing mechanism 138 is spring biased to cause the handle 40 to be urged in the direction of dotted outline arrow 142 and against slide 70. Movement in the direction of the solid arrow 140 is substantially effortless and activates the sound mechanism by rotating the sun member 134.

As noted heretofore, the handle 40 has two functions and two paths of movement. The first function of the handle 40 is to operate the sound apparatus, and for this purpose the handle 40 is oscillatable along the direction noted by arrows 140 and 142 to provide for the sound when moved in the direction indicated by arrow 140. Handle 40 also includes the camming surface 76 which is engageable with the camming edge 74 so as to move the slide 70 and thereby to disengage the lug element 88 from the notch 114. Handle 40 is movable within the first path in the direction of arrow 142 as part of the second apparatus and along a second path of movement which is in the same direction as arrow 142 but is longer than the first path of movement so that it will contact the camming edge 74 to move the slide 70. It will be noted that the housing 10 has the transverse opening 32 which provides a trackway or guideway for the handle movement and when the handle 40 is movable to the position shown in dotted outline in FIG. 3 and designated 144, the handle 40 engages the slide 70. During the revving up operation, the handle 40 has its path of oscillatory movement such that is kept just below and out of contact with the camming edge 74 of the slide 70. Should perchance the operator make contact between the handle 40 and the slide 70, then of course, the stop 50 is released and is moved from its hold to its release position. This, in turn, causes the toy vehicle to roll down the trackway 16 under the influence of gravity. Other sound mechanism, if desired, may also be provided, such as a reed or other means to cooperate with the gearing mechanism 138, although not shown, to provide other sounds. Rollers 130, 132 are formed by loosely coupling washers onto screws. The diameter of the central opening of the washers is much greater than the diameter of the mounting screws. The washers have universal movement in a direction transverse to the axis 136 and project radially outwardly from the mounting screws. In operation, rotation of the gearing mechanism 138 by means of the handle 40 brings the washers or rollers 130, 132 into contact with the knocker plate 102. To produce a motor stimulating sound, the housing 10 does function as a sound chamber and the sound may be increased in intensity by oscillating the handle 40 more rapidly.

The setting finger 54 is effective to move the shaft against the tension of the first spring 120, and the second spring 122 is effective to move the slide 70 to cause the locking lug 88 to move into engagement with the notch 114, and when the handle 40 has its camming surface 76 engaging the camming edge 74 the force of the handle is effective to move the slide 70 in a direction opposite to the urging of the spring 122 so as to cause the locking lug 88 connected to the locking element 86 to become disengaged from the notch 114; then the shaft 56 is rotatable in a direction opposite to the direction of rotation by means of the setting finger to move the stop into the transverse opening 48 and against stop limit 118. Shaft 56 is rotatable in a counterclockwise direction by means of the setting finger 54 as viewed in FIG. 1, and is rotatable in a clockwise direction by means of spring 120 in response to the disengagement of the locking elements formed by the locking element 86 together with the lug 88 from the notch 114.

It will be noted that extension portion 46 may be connected with a guided trackway (not shown) and legs 34 may besuitably connected with such trackway or they may be separately connected with any suitable base. When handle or lever 40 is rotated in the direction of the solid arrow the sound apparatus 38 is energized, and then when the handle is moved in the direction of the dotted arrow (counterclockwise in FIG. 3), the sound apparatus will provide the necessary simulating sounds so that when the handle is moved to the position indicated in dotted outline and noted with reference numeral 146 to cam the slide member 70 of a preselected point in the movement of the lever to permit launching of the toy vehicle while the sound apparatus continues to provide the launching simulating sound.

What is claimed is:

1. A toy vehicle launcher for the launching of a toy vehicle propelled under influence of gravity, comprising:

a. platform means adapted for the support of the toy vehicle in an inclined position;

b. means movable relative to said platform means from a first position to hold the toy vehicle onto said platform means to a second position to release the toy vehicle thereby to permit it to roll off said platform means under the influence of gravity;

c. setting means coupled with said movable means to position said movable means into said hold position;

d. means coupled with said setting means for urging said movable means into said release position, said setting means including means to overcome said urging means to hold said movable means in the hold position, slide means operatively associated with said setting means including second urging means and movable in response to the force of the urging of said second-mentioned urging means to lock said movable means in the hold position, and release means operatively associated with said slide means to move said slide means against the urging force of said second urging means to unlock said movable means thereby permitting said first urging means to move said movable means to the release position.

2. The launcher according to claim 1, said platform means including an inclined vehicle trackway and a side portion, said trackway having a first opening therethrough and said side portion having a second opening therethrough, said movable means including a stop movable from the release position to the hold position, said stop being positioned within said first opening parallel with said inclined vehicle trackway in its release position and being positioned transverse to said trackway projecting out of said first opening for engaging and holding the toy vehicle in its hold position, and said setting means including an outwardly projecting finger portion rotatably connected with said stop and projecting through said second opening for movement of said stop from its release to is hold position.

3. The launcher according to claim 2, said setting means including a shaft rotatably journaled to the underside of said trackway, an annular member connected with said shaft and having a cut-out portion, a lock element engageable with said cut-out portion to lock said shaft against rotation, said stop being connected with said shaft, and said second urging means being operatively connected with said lock element for maintenance thereof in engagement with said cut-out portion.

4. The launcher according to claim 3, said slide means including a slide controllably movable within a pathway under said trackway and including a first portion operatively connected with said lock element and a second portion comprising a camming edge for engagement with said release means, said release means including a handle pivotably associated with said platform means and comprising a camming surface, said camming surface being adapted for engagement with said camming edge to move said slide in said pathway against the force of said second urging means to disengage said lock element from said cut-out portion.

5. The launcher according to claim 4, said first urging means including a tension spring having one end fixedly connected with the underside of said trackway and another end connected with said rotatable shaft to spring-urge said shaft for rotation thereof to move said stop into its position parallel with said inclined trackway, said second urging means including a tension spring having one end fixedly connected with said underside of said trackway and the other end fixed to said movable slide to spring urge said locking element into engagement with said cut-out portion.

6. The launcher according to claim 5, including a housing having a lower portion and an upper portion, side portions for said upper and lower portions and means connecting said upper and said lower portions, said upper portion forming said inclined trackway, one of said side portions having an elongated slot, said camming edge of said slide projecting through said elongated slot and guided for movement transverse thereto, a sound apparatus housed within said housing comprising a knockerplate formed on the underside of said upper portion, a rotatable member including a pair of rotatable washers, loosely journaled to said rotatable member adapted to engage said knocker plate, said handle being pivotably connected with said sound apparatus, gearing interconnecting said handle with said rotatable member, said handle having two degrees of pivotal movement, one of said degrees of pivotal movement being less than the other and affecting rotation of said rotatable member, the other of said degrees of pivotal movement causing said rotatable washers to engage said knocker plate, thereby to provide for simulated sound of a vehicle to be launched and release of said finger to cause said stop to move it to its release position parallel with said trackway.

7. The launcher according to claim 2, including a housing having a lower horizontal surface and an upper inclined surface forming said trackway and said side portion, said upper surface having two inclined levels, said trackway forming one of said levels and having an elongated slot therethrough, said side portion forming said other of said levels and having an opening therethrough, both said slot and said opening communicating with the interior of said housing, a vertical sideway connecting said trackway and said side portion to guide the toy vehicle along said trackway, said housing including two parallel side walls, one of said side walls being longer than said other, said longer side wall having a transverse opening communicating with the interior of said housing extending substantially the entire height thereof, said shorter side wall having a sloped portion extending from the top thereof and forming an extension of said trackway; said setting means including a rotatable shaft journaled for rotation to the underside of said upper surface, an annular portion connected with said shaft for rotation therewith and including a notch portion; and a movable finger extending from said annular portion and projecting through said opening; a lock element engageable with said notch portion to hold said shaft against rotation; said movable means including a stop fixedly connected with said shaft and movable through said elongated slot; said first urging means including a tension spring having one end fixedly associated with the interior of said housing, means on said shaft connected with said other end of said tension spring to hold said stop within said elongated slot in said release position thereof, said shaft being movable with said movable finger for rotating said shaft against the tension of said spring and moving said cut-out portion into engagement with said lock element to maintain said stop in the hold position thereof.

8. The launcher according to claim 7, said slide means including a U-shaped trackway formed on the underside of said upper surface and communicating with said transverse opening, a slide member guided for movement in said trackway and including at one end thereof a camming edge extending through said transverse opening thereof including means connected with said lock element at a portion intermediate said ends including a spring connection post, said other end of said slide also including a guideway having an opening encompassing said annular portion for guiding the movement thereof, said annular portion passing through said last-mentioned opening, and said second urging means including a second tension spring having one end fixedly associated with the interior of said housing and the other end connected with said spring connection for urging said lock element into engagement with said notch portion, upon rotation of said annular portion to align said lock element with said notch element.

9. The launcher as claimed in claim 8, including an inner housing plate affixed to the inside portion of the underside of said upper surface, and a sound apparatus, said housing plate including means supporting journals for said shaft, stationary connection posts for holding said one ends of said springs, and a base portion on which said slide slides in said U-shaped guideway, said sound apparatus including a knocker plate connected with said underside of said upper surface and a rotatable member having peripherally disposed sound elements for engaging said knocker plate, said inner housing plate having a cut-out portion providing access to said knocker plate for said peripherally disposed sound elements, and said release means including an oscillating handle, means interconnecting said oscillating handle with said rotatable member to rotate said rotating member to cause said peripherally disposed sound elements to engage said knocker plate.

10. The launcher according to claim 9, said handle including a camming surface for engagement with said camming edge to move said slide member in said trackway to release said lock element from said notch portion, said handle having two paths of movement, one of said paths of movement activating said sound apparatus, the other of said paths of movement overcoming the tension of said second spring, said paths coinciding with said second one being longer than said first, said larger path being co-extensive with said transverse opening.

11. The launcher according to claim 1, said platform means including an inclined vehicle trackway and a side portion connected with an adjacent trackway, a first guideway in said trackway, said movable means including a stop movable in said first guideway from a position parallel to said trackway to a position transverse to said trackway and projecting out of said guideway for engaging and holding the toy vehicle, a second guideway in said side portion, said setting means including an outwardly projecting finger portion rotatably connected with said stop and projecting through said second guideway for movement of said stop from its release to its hold position, said setting means including a shaft rotatably journaled to the underside of said trackway, an annular collar connected with said shaft and including a notched portion, said finger being connected with and projecting from said annular collar through said second guideway, a lock element connected with and movable with said slide means for engagement with said notched portion to lock said shaft against rotation, said stop being connected with said shaft and projecting therefrom through said first guideway, and said second urging means including a tension spring to move said lock element into engagement with said notched portion and to hold said lock element in engagement with said notched element, thereby to maintain said stop in its hold position.

12. The launcher according to claim 11, said slide mens comprising a slide controllably movable within a pathway under said trackway, said slide pathway including a first portion comprising an upper longitudinal and a lower longitudinal guideway, a vertical guide surface connecting said upper and lower longitudinal guide surfaces, said lower longitudinal guideway being coextensive with said trackway and said upper longitudinal guideway being coextensive with said side portion, said lower longitudinal guideway including a U-shaped track, said slide including a first portion slidable along said upper longitudinal guide surface and having an edge guided by said vertical guide surface and a front portion connected with said lock element and a second portion slidable along said lower longitudinal guide surface in said U-shaped track and having a front portion overlying and connected with said first portion and having a rear portion forming a camming edge for engagement with said release means, said release means including a handle pivotably movable in said housing and having a camming surface, said camming surface being adapted for engagement with said camming edge to move said slide in said U-shaped trackway and along said vertical guide surface against the bias of said second spring biasing means to disengage said lock element from said cut-out portion.

13. In a toy vehicle launcher, a housing having an inclined surface for rollingly supporting the toy vehicle; stop means movable between a first position in which said stop means projects into the path of the vehicle, and a second position in which said stop means is out of the path of the vehicle; biasing means for biasing said stop means to said second position; retaining means for retaining said stop means in said first position; disabling means operable to disable said retaining means; sound making apparatus in said housing, for simulating the sound of a launched vehicle; and an actuating lever movable to operate said sound making apparatus and to operate said disabling means at a preselected point in the movement of said lever to permit launching of said vehicle while said sound making apparatus produces said sound.

14. In a toy vehicle as claimed in claim 13, said retaining means including a rotatable shaft, said stop means being connected with said shaft for rotation therewith, a collar on said shaft including a detent, a setting finger projecting from said collar and angularly displaced from said stop means, and a locking lug spring biased to engage said detent.

15. In a toy vehicle as claimed in claim 14, said disabling means including a slide, said lug being operatively associated with said slide, a camming edge on said slide, a trackway for said slide, said lever including a camming surface engageable with said camming edge at its preselected point of movement to move said slide to disengage said lug from said detent.

16. A toy vehicle launcher for the launching of a toy vehicle propelled under the influence of gravity, comprising a housing for containing the operating mechanisms and including a base member for support on the ground and an inclined platform connected by vertical walls to said base adapted for the support of the toy vehicle in an inclined position, a stop finger movable relative to said platform from a first position transverse to said platform to hold the toy vehicle onto said inclined platform to a second position recessed within and substantially parallel to said platform to release the toy vehicle thereby to permit it to roll off said platform under the influence of gravity, a setting finger coupled with said stop finger for setting thereof into said hold position, said platform having a longitudinal opening communicating with the interior of said housing and positioned in the area for the support of the toy vehicle, a shaft rotatably journaled to the underside of said platform with said housing and extending transversely to said longitudinal opening; said stop finger being connected with said shaft and rotatable therewith for controlled movement through said longitudinal opening so as to move from its released position within said longitudinal opening and therethrough to extend above said platform to its hold position, a stop limit under said longitudinal opening, a first biasing spring coupled with said fingers through said shaft and for urging said stop finger into its release position, said stop limit preventing said stop finger from moving into said housing and beyond the position substantially parallel to said platform, an annular collar connected with said shaft and having a notched portion movable from said release position to said hold position, a lock element engageable with said notched portion to lock said shaft against rotation and to maintain said stop finger in said hold position, said lock element including an extending lug portion adapted to engage said notched portion in the locked position of said shaft and adapted to ride on the periphery of said annular collar in the unlocked position, said setting finger being movable to rotate said shaft against the tension of said spring for movement of said lug and said notched portion into registry with each other and for engagement to hold said shaft against the tension of said spring to maintain said stop finger in said hold position, a spring biased slide including a second biasing spring to maintain said lug in engagement with said notched portion to lock said stop finger in said hold position, said slide being guidably movable on the underside of said platform, said lock element being connected with said slide for movement therewith, said second spring being tensioned to hold said lug in engagement with the periphery of said annular collar and to move said lug into engagement with said notched portion when moved into registry therewith, and a release lever operable to move said spring biased slide to unlock said stop finger.

17. The toy vehicle launcher according to claim 16, the underside of said platform including guide means for said slide, said underside of said platform having first and second portions, said first portion being raised with respect to said second portion and including a guide edge trackway, connecting said first and second portions, said guide means including a pair of vertical guide rails extending from said second portion, said slide comprising a first member adapted to ride on said second portion between said guide rails and a second member connected with said first member adapted to ride on said first portion and along said guide edge, said first member including an extension overlying said second portion maintaining said second member positioned against said second portion, said lock element being connected with said second portion, said second member including a further guide to guide said slide, said further guide comprising a transverse opening in said second member encompassing said annular collar, said extending lug portion being connected with said further guide, said first member including a camming edge engageable with and responsive to said release means to overcome the biasing of said second spring to move said slide within said guide rails longitudinally therewith, to disengage said extending lug portion from said notched portion.

18. The launcher according to claim 17, one of said vertical walls having an elongated slot, said camming edge of said slide projecting through said elongated slot and guided for movement transverse thereto, a sound apparatus housed within said housing comprising a knocker plate formed on the underside on said first portion, a rotatable member including a pair of rotatable washers, loosely journaled to said rotatable member adapted to engage said knocker plate, said handle being pivotably connected with said sound apparatus, gearing interconnecting said handle with said rotatable member, said handle having two degrees of pivotal movement, one of said degrees of pivotal movement being less than the other and affecting rotation of said rotatable member, the other of said degrees of pivotal movement causing said rotatable washers to engage said knocker plate, thereby to provide for simulated sound of a vehicle to be launched and release of said setting finger to cause said stop finger to move it to its release position parallel with said trackway, and an inner housing plate affixed to the inside portion of the underside of said platform and underlying said slide for holding thereof between said guide rails, said housing plate including means supporting journals for said shaft, stationary connection posts for holding said one ends of said springs, said inner housing plate having a cut-out portion providing access to said knocker plate for said peripherally disposed sound elements, and said release means including an oscillating handle, said handle being spring biased with said sound apparatus, means interconnecting said oscillating handle with said rotatable member to rotate said rotating member to cause peripherally disposed sound elements to engage said knocker plate, said handle havin two paths of movement, one of said paths of movement activating said sound apparatus, the other of said paths of movement being rendered operative upon release of the handle, to cause said camming surface to engage said camming edge thereof overcoming the tension of said second spring, said paths coinciding with said second one being longer than said first, said larger path being coextensive with said transverse opening.

* * * * *